US011828095B2

(12) United States Patent
Frankel

(10) Patent No.: US 11,828,095 B2
(45) Date of Patent: Nov. 28, 2023

(54) SLIDING DOOR SYSTEM CAPABLE OF INLINE CLOSURE AND CAPABLE OF USE WITH CORNER OPENINGS

(71) Applicant: INLAY DOOR SYSTEMS LLC, Houston, TX (US)

(72) Inventor: Scott Frankel, Houston, TX (US)

(73) Assignee: INLAY DOOR SYSTEMS LLC, Houston, TX (US)

( * ) Notice: Subject to any disclaimer, the term of this patent is extended or adjusted under 35 U.S.C. 154(b) by 15 days.

(21) Appl. No.: 17/390,619

(22) Filed: Jul. 30, 2021

(65) Prior Publication Data

US 2022/0049531 A1 Feb. 17, 2022

Related U.S. Application Data

(62) Division of application No. 16/297,246, filed on Mar. 8, 2019, now Pat. No. 11,105,132.

(60) Provisional application No. 62/640,412, filed on Mar. 8, 2018.

(51) Int. Cl.

| | |
|---|---|
| ***E05D 15/10*** | (2006.01) |
| ***E06B 3/46*** | (2006.01) |
| ***E06B 3/988*** | (2006.01) |
| ***E05D 15/06*** | (2006.01) |

(52) U.S. Cl.

CPC ..... *E05D 15/10* (2013.01); *E05D 15/0604* (2013.01); *E06B 3/4654* (2013.01); *E06B 3/988* (2013.01); *E05Y 2900/14* (2013.01)

(58) Field of Classification Search

CPC . E05D 15/10; E05D 15/1065; E05D 15/0604; E06B 3/4654; E06B 3/988

See application file for complete search history.

(56) References Cited

U.S. PATENT DOCUMENTS

| | | | | |
|---|---|---|---|---|
| 24,535 | A * | 6/1859 | Birdsall | 16/307 |
| 466,164 | A * | 12/1891 | Gray | E05D 15/1068 49/212 |
| 565,286 | A | 8/1896 | Gros | |
| 914,411 | A * | 3/1909 | Hill | E05D 15/1068 49/212 |

(Continued)

FOREIGN PATENT DOCUMENTS

| | | | |
|---|---|---|---|
| CA | 2739737 | A1 | 11/2012 |
| CH | 386279 | A | 12/1964 |

(Continued)

OTHER PUBLICATIONS

Machine translation of EP-956799-A2.*

(Continued)

*Primary Examiner* — Marcus Menezes

(74) *Attorney, Agent, or Firm* — Mayer Brown LLP

(57) ABSTRACT

A sliding door system for inline closure of an opening in the wall of a structure, which may be a building or an item of furniture, for example, that includes a door panel, a guiderail assembly, and a guiderail coupled to the wall mount via a (Continued)

plurality of doubled-hinge assemblies that together serve to allow the guiderail to pivot towards and away from the wall, and includes a stop on the guiderail that serves as a catch, or cam, that causes a closing force on the door panel to be transferred to the double-hinge assemblies and to cause the door panel to be pulled into inline closure in the opening.

7 Claims, 14 Drawing Sheets

(56) References Cited

U.S. PATENT DOCUMENTS

| | | | | | |
|---|---|---|---|---|---|
| 937,810 | A | | 10/1909 | Hussey | |
| 3,611,637 | A | * | 10/1971 | Saino | E05D 15/1021 49/235 |
| 3,728,819 | A | | 4/1973 | Goldbach et al. | |
| 3,906,668 | A | | 9/1975 | Simmons | |
| 4,619,076 | A | | 10/1986 | Wiles | |
| 4,802,307 | A | | 2/1989 | Schmidt | |
| 5,069,512 | A | * | 12/1991 | Sykes | E06B 5/006 312/139.2 |
| 5,911,519 | A | * | 6/1999 | Eutebach | A47K 3/362 4/607 |
| 8,375,645 | B2 | | 2/2013 | Iwauchi et al. | |
| 2009/0126279 | A1 | | 5/2009 | Kopish | |
| 2010/0205865 | A1 | | 8/2010 | Iwauchi et al. | |
| 2011/0162281 | A1 | * | 7/2011 | Massey | E05C 7/04 49/365 |
| 2012/0279130 | A1 | * | 11/2012 | Appeldoorn | E06B 3/4645 49/252 |

FOREIGN PATENT DOCUMENTS

| | | | | | |
|---|---|---|---|---|---|
| DE | 961949 | C | | 4/1957 | |
| DE | 19601287 | A1 | | 7/1997 | |
| EP | 956799 | A2 | * | 11/1999 | A47K 3/34 |
| JP | 2005255259 | A | * | 9/2005 | |
| WO | 2019/173755 | A1 | | 9/2019 | |

OTHER PUBLICATIONS

Machine translation of JP-2005255259-A.*
International Search Report received in PCT/US19/21419 and dated May 17, 2019 (3 pages).
Written Opinion received in PCT/US19/21419 and dated May 17, 2019 (14 pages).
Fleetwood Corner Sliding Door (Sunex International Inc.) Feb. 19, 2016, available at <https://www.youtube.com/watch?v=...4i6xcklNrE>.
"Astragal" (Wikipedia) Nov. 30, 2016, available at <https://en.wikipedia.org/wiki/Astragal>.
1 Supplementary European Search Report of EP 19765135 dated Sep. 27, 2021 (7 pages).

* cited by examiner

SLIDING DOOR SYSTEM CAPABLE OF INLINE CLOSURE AND CAPABLE OF USE WITH CORNER OPENINGS

CROSS-REFERENCE TO RELATED APPLICATIONS

This application is a division of U.S. application Ser. No. 16/297,246, filed Mar. 8, 2019 which claims the benefit of U.S. Provisional Application No. 62/640,412, filed Mar. 8, 2018, which are hereby incorporated by reference in their entirety as if fully set forth herein.

FIELD OF THE INVENTION

The present invention relates generally to sliding doors that are suitable for a variety of applications. More specifically, the invention relates to sliding doors that are capable of inline closures.

BACKGROUND OF THE INVENTION

Sliding doors are utilized in a number of different applications for residential, commercial, and industrial structures, including both internal and external applications. One common use of sliding doors in commercial structures is in retail or grocery stores, where sliding doors may serve as the ingress or egress point for customers. Similarly, sliding doors in residential structures may be used in external applications as doors connecting the rear of a home to an outdoor patio area, or in internal applications as, for example, decorative glass paned doors for separating rooms in a home. Sliding doors are also frequently used within a home as doors to closets, particularly within bedrooms. Sliding doors can also found in a variety of furniture applications, such as in cabinets, servers, or in television stands. And sliding doors are even found in automotive applications, such as in the passenger doors for vans or minivans.

One advantage of sliding doors is that they do not require a significant amount of clearance in the direction perpendicular to the opening in which they sit. As a result, sliding doors are particularly suitable for applications where there is a limited amount of space in front of or behind an opening, such that a hinged door would not have adequate space to open properly in either or both directions. The disadvantage, however, is that existing sliding doors typically require more room in the transverse direction than hinged doors. In general, a sliding door will require a clearance space in the direction parallel to the opening it which the door sits that its at least equal to the size of the door itself. This need for clearance space imposes limitations on the use of sliding doors in certain application. For example, if an individual wishes to use a sliding door in a particular space, the user may be limited in the size of the door (and thus the size of the opening serviced by the door) in order to allow for adequate space in the transverse direction. Such limitations are particularly disadvantageous in scenarios where larger openings between spaces are desired. Existing sliding doors, such as patio doors, also typically require a fixed or inoperable panel that restricts the size of the actual opening that may be used. In addition, most sliding door systems have one or more tracks, which are difficult to maintain and often end up collecting waste and other debris which can impede the operation of the door.

In addition to having certain restrictions relating to the size of the opening, existing sliding door are also, by their nature, generally limited in the shape of the openings that they can service. In particular, existing sliding doors are generally limited to servicing openings that are straight, or substantially straight. Existing sliding doors typically cannot be used to service openings having more complex shapes, such as corners.

Another disadvantage of existing sliding doors is that they generally do not provide for adequate sealing, particularly when compared to hinged doors. For this reason, when existing sliding doors are used for external applications, they may result in energy inefficiencies and the inability to adequately protect against the elements. Even where existing sliding doors are designed to provide more substantial sealing, such as in sliding doors used in automobile applications, these doors tend to require substantial and complex track arrangements that are not suitable for building applications or are not aesthetically pleasing.

In recent years, so-called "barn door" type sliding doors have become particularly desirable in certain residential, commercial, and even industrial applications. In addition, such barn doors have become desirable features in a variety of different furniture applications, including entertainment centers, cabinets, and wardrobes. However, such barn-type sliding doors do not allow for adequate sealing, and are therefore generally limited to purely internal applications. In addition, such barn door-type sliding doors are subject to size limitations like traditional sliding doors, and often require that the barn door be larger than the opening itself. In addition, existing barn door-type doors are generally poor at isolating noise between rooms, and often times appear to amplify noises. Existing barn door-type doors also typically hang freely from an upper track and lack any sort of connection or support on the lower half of the door, which creates a risk of the door swinging away from the opening and off of the upper track. Also, when used in furniture applications, existing barn door-type sliding doors by their very nature require that a portion of the furniture always be opened.

In view of the above, it would be beneficial to have a sliding door that enjoys the particular advantages of sliding doors, but that also overcomes the various drawbacks and disadvantages of existing sliding doors. In addition, it would be beneficial for such a door to be aesthetically pleasing and avoid the need for complicated track systems.

SUMMARY OF THE INVENTION

Aspects and advantages will become apparent to those of ordinary skill in the art by reading the following detailed description, with reference where appropriate to the accompanying drawings. Further, it should be understood that the foregoing summary is merely illustrative and is not intended to limit in any manner the scope or range of equivalents to which the appended claims are lawfully entitled.

BRIEF DESCRIPTION OF THE DRAWINGS

The invention is described below in connection with the following illustrative figures, wherein.

It should be noted that the figures herein are not to scale, and the sliding door apparatus herein is not limited to the scale shown in the figures.

DETAILED DESCRIPTION

While the present invention is capable of being embodied in various forms, for simplicity and illustrative purposes, the principles of the invention are described by referring to several embodiments thereof. It is understood, however, that the present disclosure is to be considered as an exemplification of the claimed subject matter, and is not intended to limit the appended claims to the specific embodiments illustrated. It will be apparent to one of ordinary skill in the art that the invention may be practiced without limitation to these specific details. For example, although the embodiments are described in the context of interior and exterior wall applications, the invention can also be used for various furniture applications and any other applications where a door might be used. As other examples, the invention can be used as a safe door, a hidden room door (such as integrated into a bookshelf or other furnishing typically located along a wall), or as a glass shower door. Additionally, as persons of ordinary skill in the art will appreciate, in certain instances, well-known methods and structures have not been described in detail so as not to unnecessarily obscure the invention.

Figure 1A:
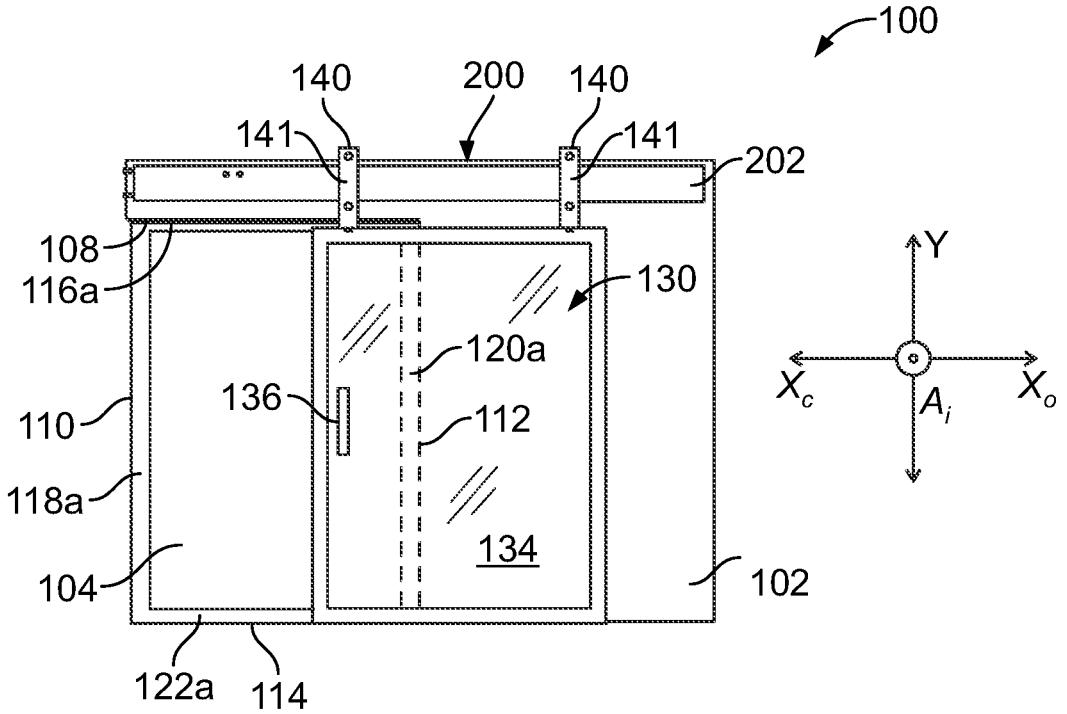
FIGS. 1*a* and 1*b* are front views of a sliding door apparatus in an open position and a closed position, respectively, according to an embodiment of the invention.

FIG. 1*a* shows a sliding door system 100 in an open position according to a first embodiment. The sliding door system 100 services an opening 104 in a wall 102 in such a way as to selectively obstruct the opening 104. The opening 104 and wall 102 define a plane having a vertical axis Y and a longitudinal axis X, having an opening direction $X_o$ and a closing direction $X_c$. The opening 104 and wall 102 also define a transverse axis, A, that is perpendicular to the plane defined by the opening 104 and wall 102, and that has an inward direction, $A_i$, that is in the direction of the side of the wall to which a guiderail assembly is attached (out of the page, with reference to FIG. 1*a*), and an outward direction, $A_o$, that is in the opposite direction (into the page, with reference to FIG. 1*a*). The opening 104 is defined by a frame 106 included in the wall 102 having a head 108, a leading side jamb 110, a trailing side jamb 112, and a sill 114. Alternatively, the bottom of the opening 104 may be defined by a floor instead of by a sill 114. Attached to the frame 106 are a top stop 116, a leading side stop 118, and a trailing side stop 120. The frame 106 may also include a bottom stop 122.

Figure 1B:
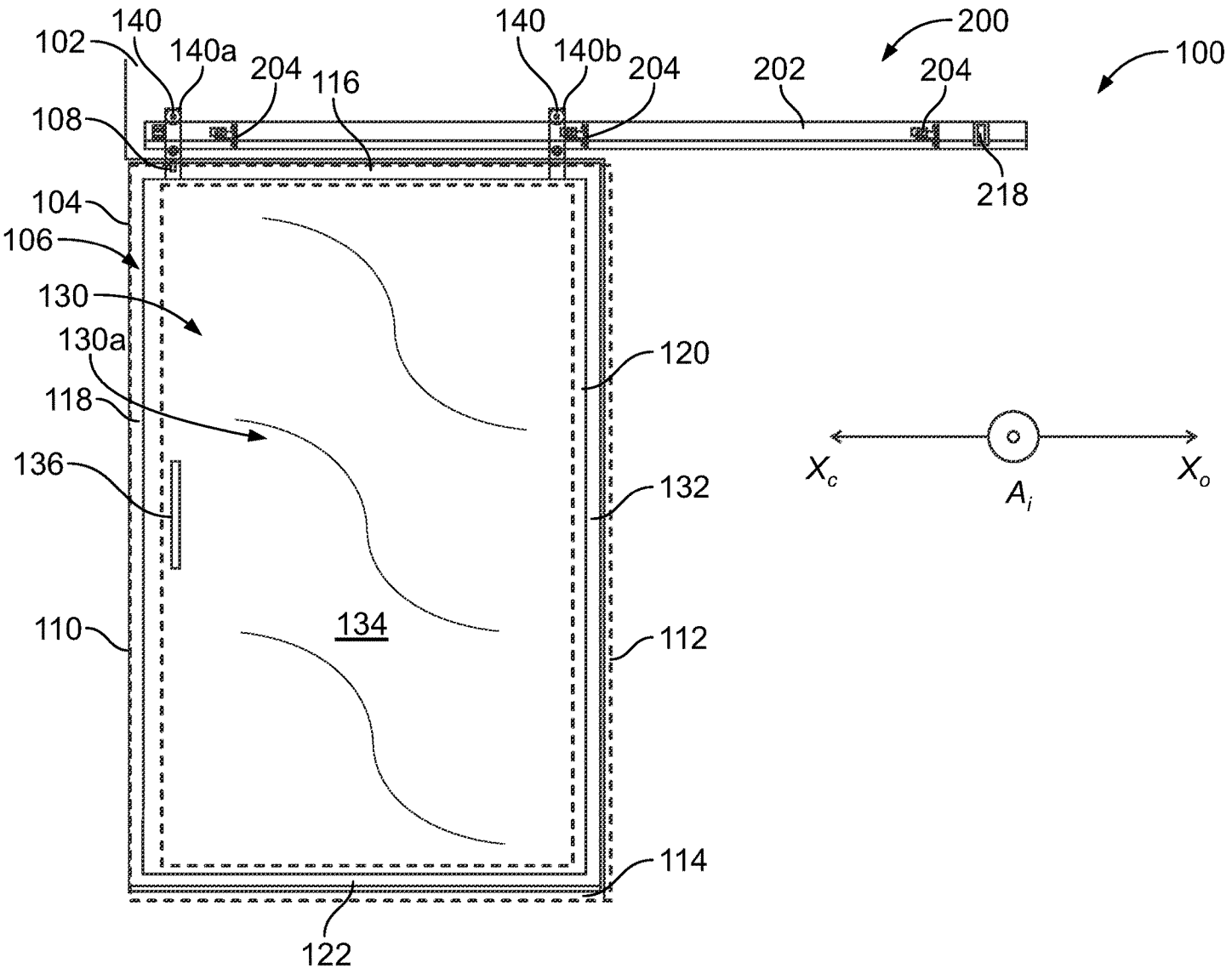

The sliding door system 100 is capable of being placed in an open position, as shown in FIG. 1*a*, wherein the door panel 130 minimally obstructs opening 104 such that no portion (or only a relatively small portion) of the door panel 130 overlaps with opening 104. The sliding door system is also capable of being placed in a closed position, as shown in FIG. 1*b*, in which the door panel 130 substantially blocks the opening 104 and is capable of forming a sealed closure in connection with the frame 106 and associated stops 116, 118, 120, 122. The interior-facing side of each of the stops (116*a*, 118*a*, 120*a*, 122*a*) has material thereon to facilitate a sealed closure when the single door panel 130 is in the closed position. This material may be any type of sealing material or weatherstripping that is known in the art, including, for example, strips of insulating material. Alternatively, the sealing material may be located within those portions of the edges of the door panel 130 that make contact with the stops in the closed position.

As shown in FIGS. 1*a* and 1*b*, the panel 130 has a frame 132 that defines the overall shape of the door. As shown in FIGS. 1*a* and 1*b*, the shape of the frame 132, and of the door, is rectangular, although other shapes may be used. Attached to the frame 132 is a lite of glass 134. Attached to the interior surface 130*a* of the door is an attachment 136, such as a knob or a handle, to provide a means for a user to grasp the door an exert a force on the door panel 130 in order to facilitate closing and opening of the door panel 130.

Figure 2A:
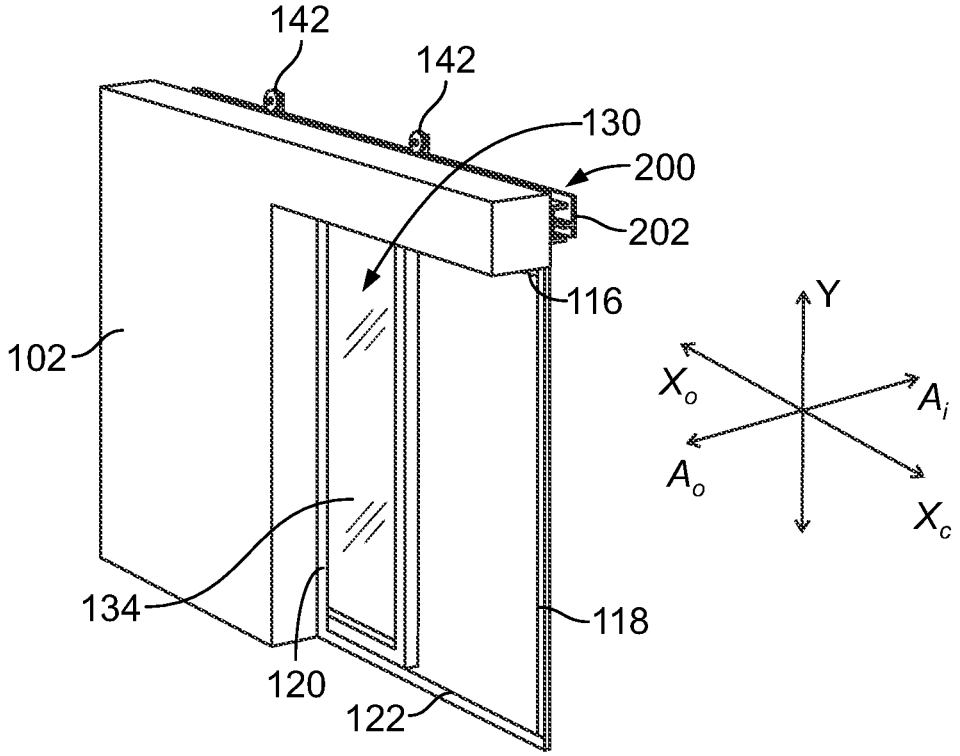
FIGS. 2*a*, 2*b*, and 2*c* are exterior perspective views of a sliding door apparatus in the open position, at the transition point, and in the closed position, respectively, according to an embodiment of the invention.
Figure 2B:
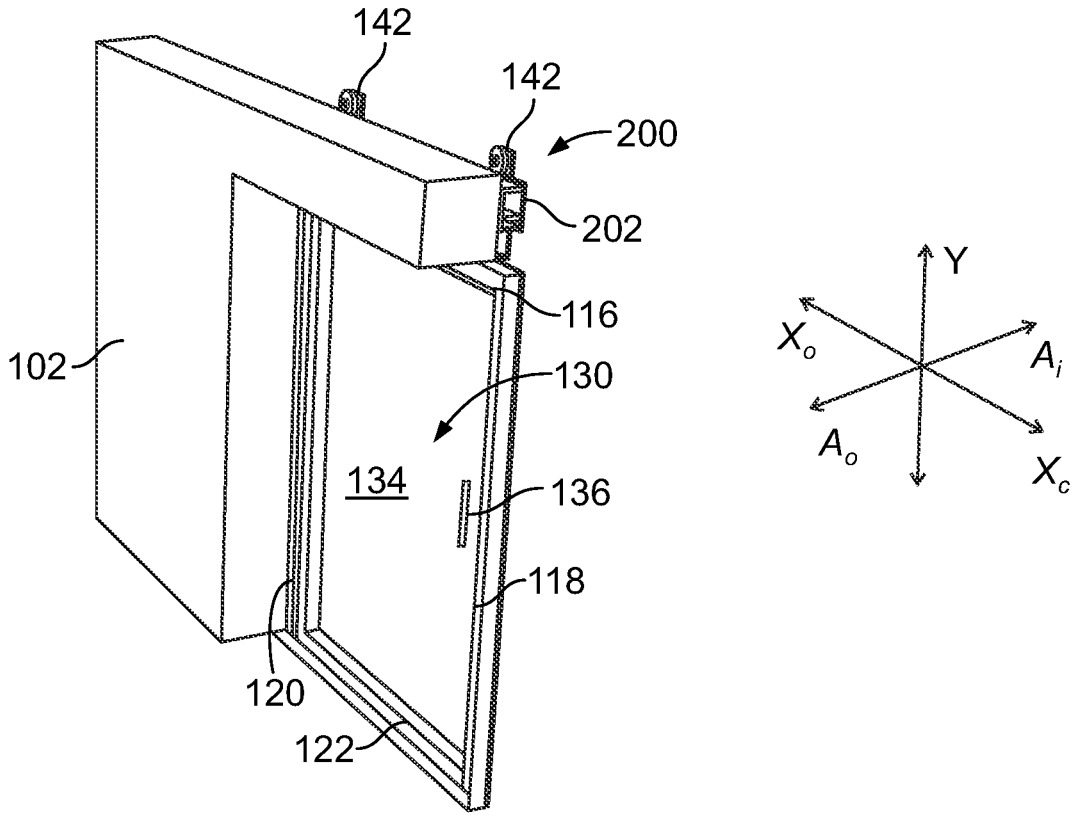
Figure 2C:
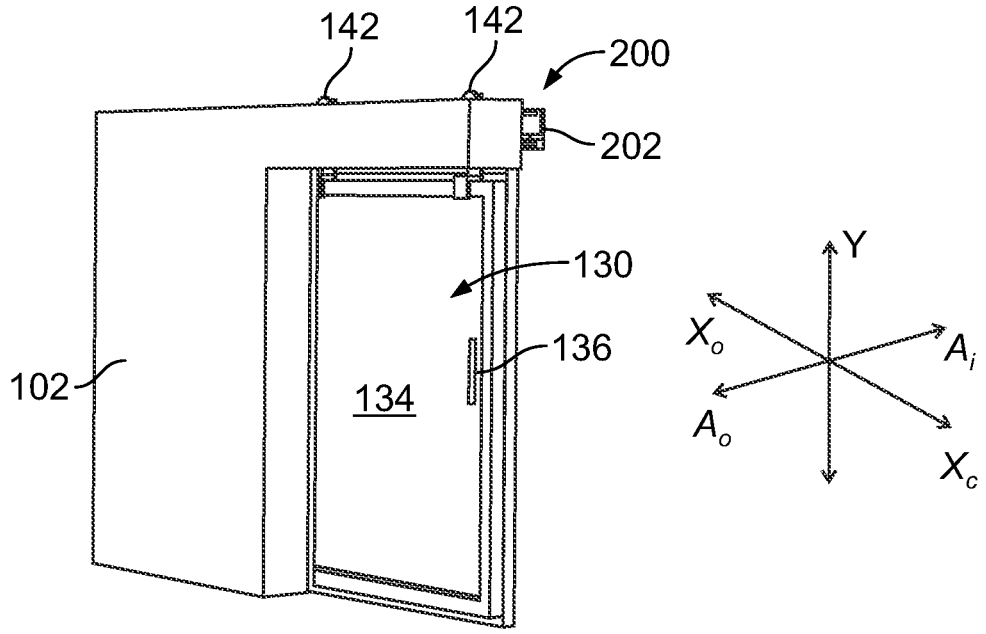

Although the embodiment shown in FIGS. 1 and 2 has door panel 130 made of glass (for ease of illustration and explanation of the components of the door system 100), other arrangements of the door panel 130 may be used without departing from the scope of the invention. For example, the door may include one or more wooden panels or lengths such as might be used in barn door-type sliding doors that are known in the art, or it may take the form of a French door having multiple lites divided by muntins attached to the frame. As another example, when used to create a hidden door, the door panel may have attached thereto a bookcase or other piece of furnishing that is typically placed against a wall.

Figure 3A:
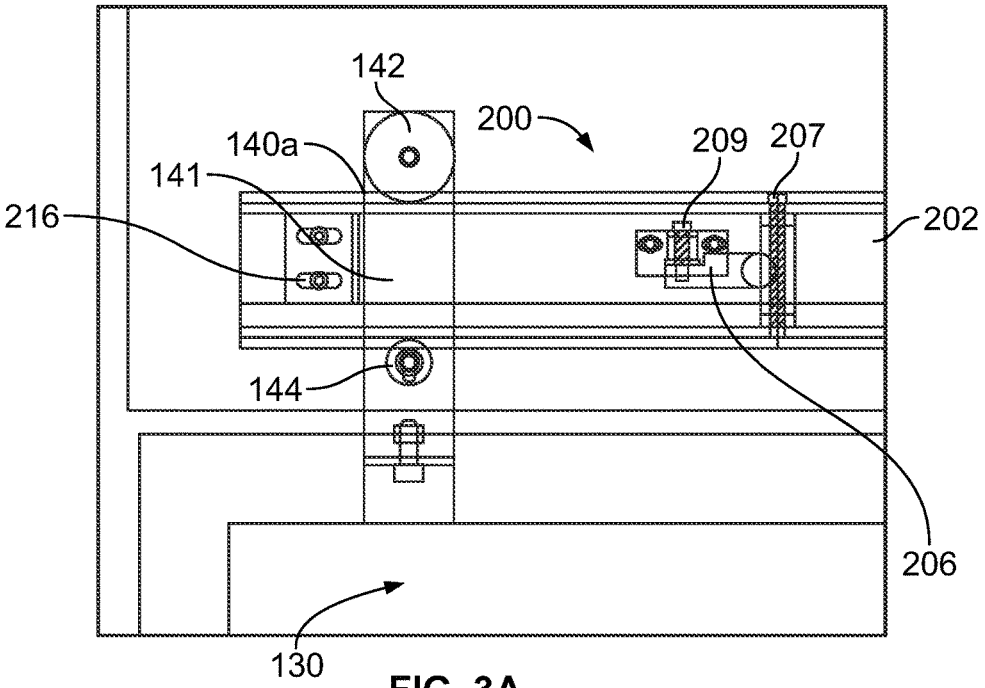
FIGS. 3*a*, 3*b*, and 3*c* are interior detail views of an upper portion of the sliding door apparatus at a transition point, and in an open position, respectively, according to an embodiment of the invention in the closed position.
Figure 3B:
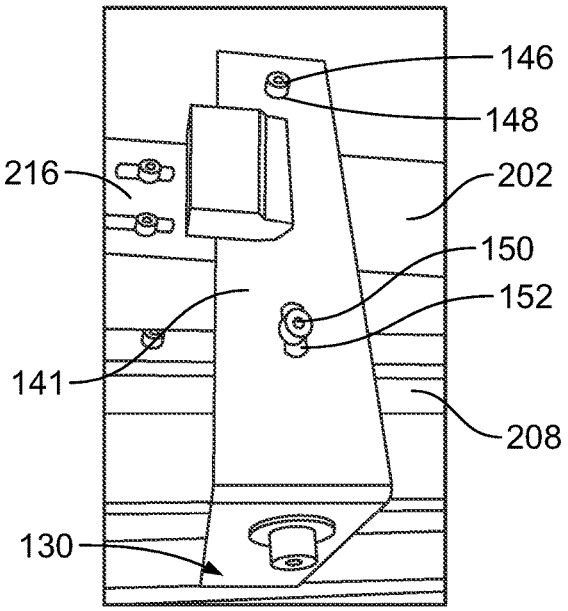
Figure 3C:
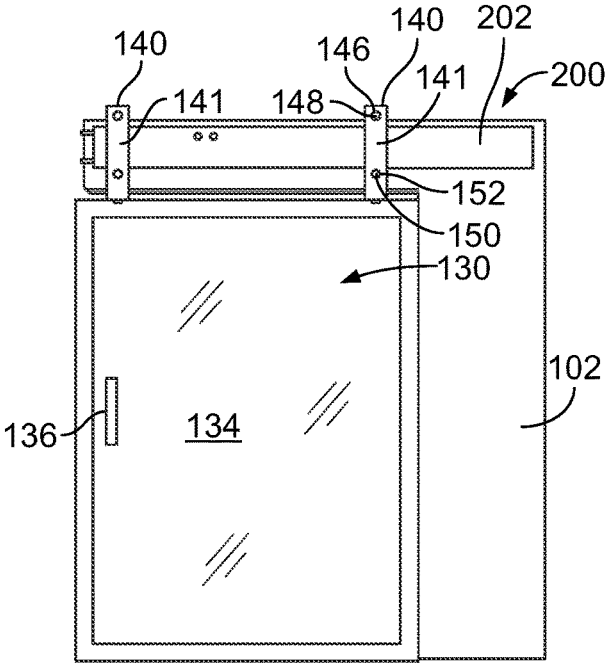
Figure 4B:
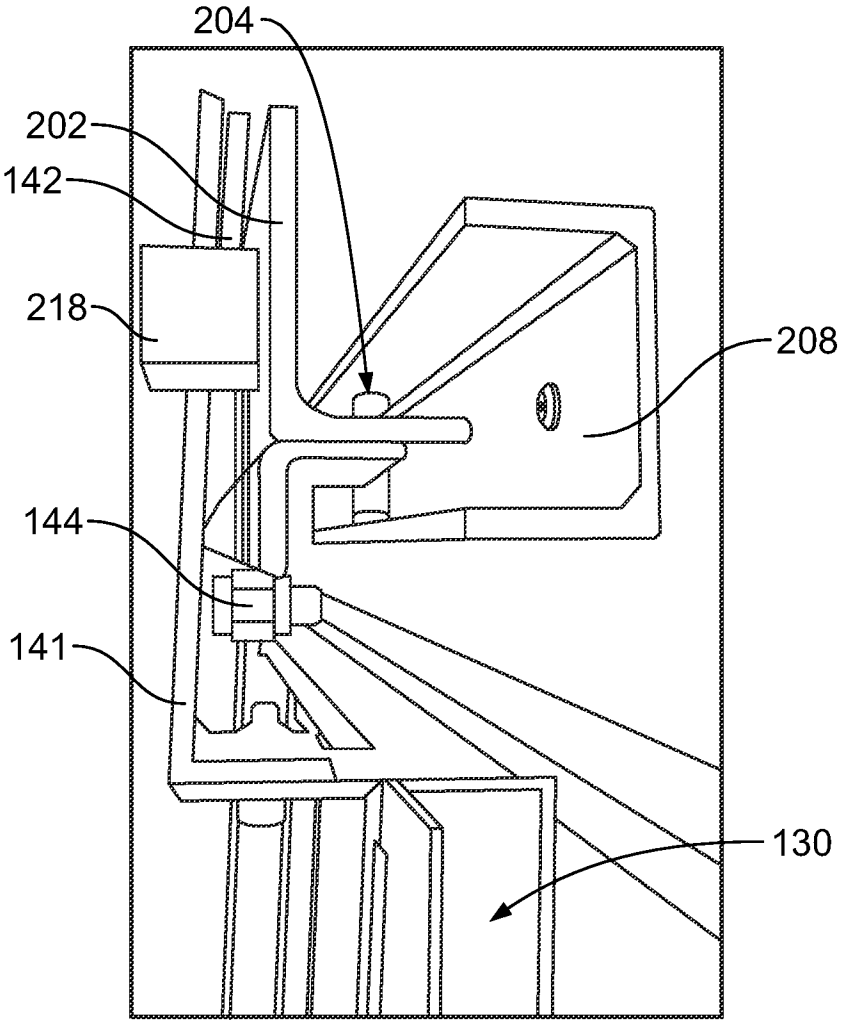
FIGS. 4*a* and 4*b* are detail cross-sectional views of an upper portion of the sliding door apparatus in a closed position and in an open position, respectively, according to an embodiment of the invention.
Figure 4A:
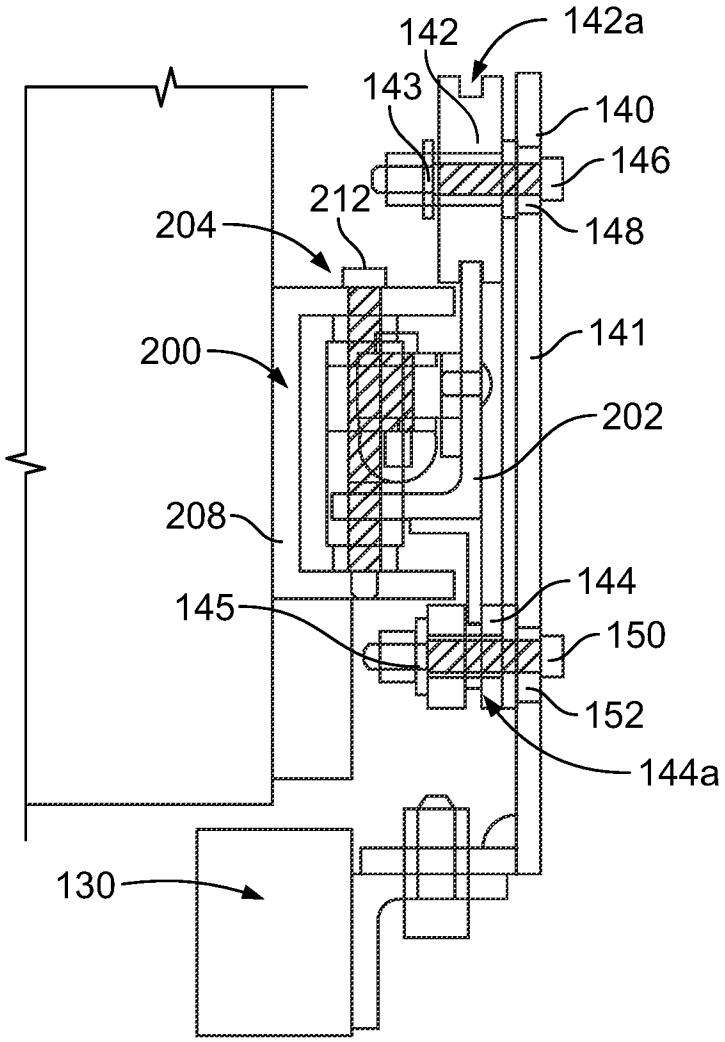
Figure 10:
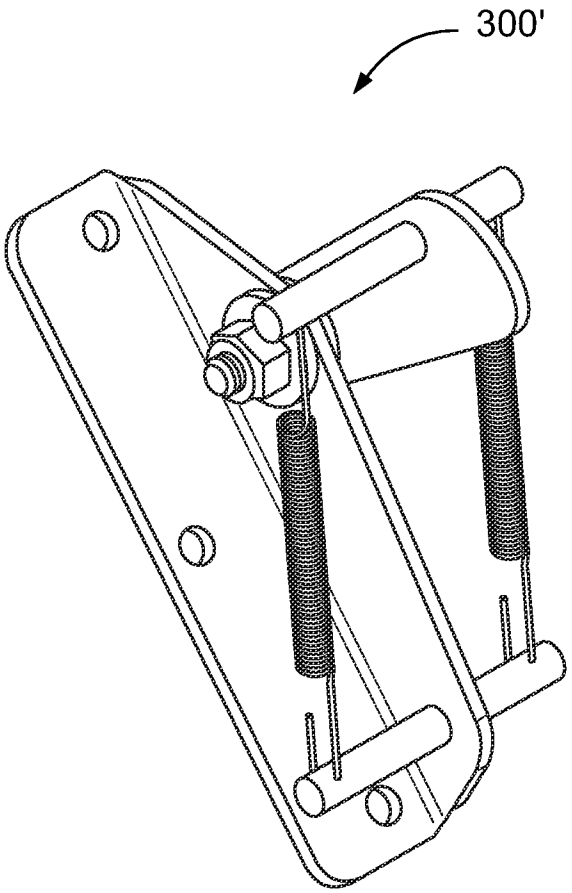
FIG. 10 is a detail perspective view of an alternative transition support assembly of the sliding door apparatus according to an embodiment of the invention.

The sliding door system 100 includes a guiderail assembly 200 that facilitates sliding of the door panel 130 in the longitudinal axis. The guiderail assembly 200 includes a rigid straight guiderail structure 202 along which the door panel 130 slides in the longitudinal axis through the interaction with one or more roller assemblies 140. Although the guiderail assembly shown in the FIGS. 1-2 is mounted to an interior side of the wall, the guiderail assembly and guiderail may instead be attached within the opening at the head (top portion) thereof, which may be useful in embodiments where a sleeker or lower-profile design is desired or where there is not sufficient clearance for a guiderail assembly to be mounted above the opening. As shown in FIGS. 3*a* through 3*c*, each roller assembly 140 has an arm 141, having an L-shaped cross section, that has attached, at an upper portion thereof, one or more rollers 142 adapted to engage with the guiderail 202 so as to be capable of rolling along the length of the guiderail 202 in the longitudinal axis. The roller 142 is attached to the upper portion of the arm 141 by means of a shoulder bolt 146, which passes through an opening 148 in the upper portion of the arm 141 and through the bearing 143 of the roller 142. The opening 148 is slotted in the vertical direction, which allows for the vertical position of roller 142 with respect to the arm 141 to be adjusted up and down in the vertical direction, to allow fine adjustments of the height of the door panel in the opening, and with respect to the guiderail assembly. As shown in FIGS. 4*a* and 4*b*, each roller 142 has a central grove 142*a* that mates with a top surface of guiderail 202, thereby increasing the stability of the engagement between the guiderail 202 and the rollers 142 (and thus roller assemblies 140 overall). Each roller assembly 140 is fixedly attached, at a lower portion of the arm 141, to an upper portion of the door panel 130. In this way, the roller assemblies 140 slidably couple the door panel 130 to the guiderail 202, and thus to the guiderail assembly 200. Although the embodiment shown in FIGS. 1 and 2 have two roller assemblies, more roller assemblies may be utilized in order to increase the stability of the door system, or to lessen the load on each individual roller assembly.

Each roller assembly 140 may further include complimentary rollers 144 adapted to engage with a lower surface of guiderail 202. Similar to the top rollers 142, the complimentary lower rollers 144 have a central grove 144*a* that mates with the guiderail. In this way the rollers 142 and the complimentary rollers 144 of each roller assembly 140 engage the top and bottom edges of the rigid guiderail 202, thereby increasing the stability of the coupling between the door panel 130 and the guiderail assembly 200 and helping to avoid accidental disengagement of the door panel 130 from the guiderail assembly 200. The complimentary roller 144 is attached to the lower portion of the arm 141 by means of a shoulder bolt 150, which passes through an opening 152 in the lower portion of the arm 141 and through the bearing 145 of the roller 144. Like the opening 148 for the top roller, the opening 152 for the complimentary roller is slotted in the vertical direction to allow for the vertical positioning of the complimentary roller 144 with respect to the arm 41 and to allow fine adjustments of the height of the door panel in the opening, and with respect to the guiderail assembly.

The guiderail assembly 200 also facilitates sealing of the door by forcing the door panel 130 towards and into the plane of the opening 104 when transitioning into the closed position, and similarly facilitates unsealing of the door by forcing the door panel 130 out of the plane of the opening 104 when transitioning out of the closed position and towards the open position. To provide this functionality, the guiderail 202 is coupled to the wall 102 via a plurality of double-pivot hinge assemblies 204, as shown in FIGS. 1*b* and 4*b*. Although the embodiment shown in FIG. 1*b* has three double-pivot hinge assemblies, only two such assemblies are required. Alternatively, the inline sliding door system may include three or more double-pivot hinge assemblies in order to increase the overall stability of the door system, or to lessen the load on each individual hinge assembly.

Figure 5:
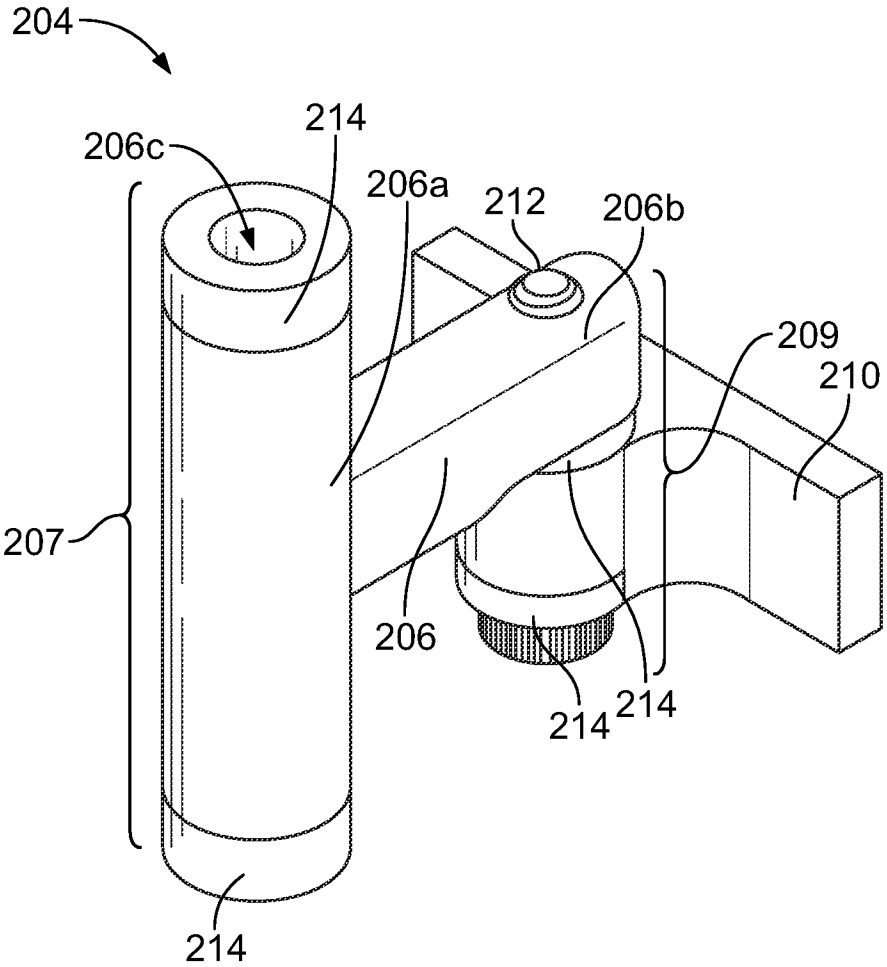
FIG. 5 is a detail perspective view of a double-pivot hinge assembly of the sliding door apparatus according to an embodiment of the invention.

As shown in detail in FIG. 5, each hinge assembly 204 has an arm 206 that is pivotally attached via a first hinge 207 to a wall mount 208 at a first end 206*a* of the arm 206, and is also pivotally attached via a second hinge 209 to a guiderail mount 210 at a second, opposite end 206*b* of the arm. As shown in FIGS. 4*a* and 4*b*, wall mount 208 is a bracket with a C-shaped cross section, with hinge assemblies 204 being mounted within the bracket. With reference to FIG. 4*b* and FIG. 5, the first end 206*a* of the arm 206 is pivotally attached to the wall mount 208 by means of a first shoulder bolt 212 that extends through a barrel 206*c* in the first end 206*a* of the arm and through holes 208*a* in the wall mount 208, were the barrels and holes are sized accordingly to receive the first shoulder bolt 212. In this way, first shoulder bolt 212 serves as a hinge pin for the first hinge 207, at the wall, of the hinge assembly 204. Similarly, the second end 206*b* of the arm 206 is pivotally attached to the guiderail mount 210 by means of a second shoulder bolt 214 that extends through a barrel 206*d* (not shown) in the second end 206*b* of the arm and through a corresponding barrel 210*a* (not shown) in the guiderail mount 210. In this way, second shoulder bolt 212 serves as a hinge pin for the second hinge 209, at the guiderail, of the hinge assembly 204. To reduce friction in the two hinges of each hinge assembly 204, and to facilitate pivoting of the hinge assembly at the hinges, one or more bearings 214 are situated between the barrels of the arm 206 and the barrels of the wall mount 208 and guiderail mount 210, respectively.

As shown in FIG. 1, the double-pivot hinge assemblies 204 are spaced along the length of the guiderail mount 210. In this manner, the one or more double-pivot hinge assemblies 204 operate in concert to keep the guiderail in a plane parallel to the wall throughout operation of the sliding door system 100. As illustrated in FIG. 3*a*, in the closed position, the arm 206 of each pivot hinge 204 is aligned in the same direction. As the system is transitioned out of the closed position and begins to transition into the open position via an external force in the inward direction, as further described below, the arm 206 of each hinge assembly 204 begins to pivot at the first hinge 207 causing the guiderail to move in an arcing motion directed inward $A_i$ and in the opening longitudinal direction $X_o$, until the transition point, which is the point where the guiderail reaches its maximum distance inward, as determined by the design of the double-pivot hinge assemblies 204 (where the maximum inward distance is a function of the maximum pivoting range of the first hinges 207 and the length of the arms 206), or by the design of the transition support assembly 300 (where the maximum inward distance is a function of the length of the lever arm 302), alternative transition support assembly 300', or a combination of the designs of these assemblies.

The hinges of the double-pivot hinge assemblies 204 have a full range of motion in the opened and closed position. The overall movement and operation of the hinges, which affects their pivoting range, is managed by a stop mounted on the pivoting hinge. This stop can be adjusted to managed the degree to which the door can be opened. In another embodiment, the pivot range of the first hinge is restricted to a maximum pivoting range by stops within the hinge. As shown in FIG. 3*b*, this maximum pivoting range is substantially normal to the plane of the wall in the inward direction $A_i$ (i.e., substantially 90 degrees), within 1 to 2 degrees of tolerance. Alternatively, this maximum pivoting range may be less than substantially 90 degrees, and may be 85, 80, or 75 degrees, again within 1 to 2 degrees of tolerance for each. Alternatively or additionally to the maximum pivot range of the first hinge being restricted (and thus determined) by stops within the hinge, the maximum pivoting range of the first hinge is restricted based on the length of the lever arm 302 in the transition support assembly 300, as further described below.

The overall design and operation of the double-pivot hinge assemblies, and in particular the maximum pivoting range of the first hinges 207 and the length of the arms 206 as provided by any stops, is such that they provide sufficient movement of the door panel 130 in the inward direction $A_i$ to allow the door panel 130 to completely clear out of the opening 104. In particular, the double-pivot hinge assemblies are designed so as to permit the guiderail 202, and thus the door panel coupled to the guiderail, to move in the inward direction a distance that is at least equal to the thickness of the trailing side jamb 112 that defines opening 104, and including up to an additional clearance distance that will range anywhere from a hundredth of an inch, to a tenth or a quarter of an inch, to one to several inches, depending on the context and use of the sliding door system.

As the first hinges 207 of each double-pivot hinge assembly 204 pivot, the second hinges 209 of the assemblies counter-pivot in such a manner as to ensure that the rigid guiderail 202, and thus the door panel 130, remain parallel to the opening 104 throughout the transition into and out of the closed position.

Guiderail assembly 200 further includes an adjustable front stop 216 that operates so as to limit the extent to which the door panel 130 can roll along the guiderail 202 in the closing longitudinal direction $X_C$. As described below, the adjustable stop 216 also operates as a catch, or a cam, that causes additional external force in the closing longitudinal direction to be translated into a force acting on the double-pivot hinge assemblies 204 and causing the guiderail 202, and thus the door panel 130 connected to the guiderail 202, to move in an arcing motion towards the closing longitudinal direction and into the plane of the opening 104. Sliding door panel 130 is free to slide, via rolling assemblies 140, along the length of the guiderail 202 in the closing longitudinal direction $X_C$ until the arm of the lead rolling assembly 140*a* contacts adjustable stop 216, whereupon further displacement in the closing longitudinal direction is restricted. Because further displacement along the guiderail in the closing longitudinal direction is restricted in this manner, any additional force applied to the door panel 130 in that direction is translated via the catch 216 into the guiderail 202 and into a pivoting force acting upon the respective arms 206 of hinge assemblies 204 and causing them to pivot at first hinges 207 from alignment in the transverse direction into alignment in the closing longitudinal direction. As noted above, the second hinges 209 in the double-pivot hinge assemblies 208 counter-pivot to ensure that guiderail 202 and thus the door panel 130 remain parallel to the plane of the opening 104 throughout this transition. Stop 216 is adjustable in the longitudinal axis and can be adjusted in the closing longitudinal direction or the opening longitudinal direction to ensure that the door panel 130 is properly aligned within opening 104.

Guiderail assembly 200 further includes a rear stop 218 that operates so as to limit the extent to which door panel 130 can roll along the guiderail 202 in the opening longitudinal direction $X_O$. Sliding door panel is free to slide, via rolling assemblies 140, along the length of the guiderail 202 in the opening longitudinal direction $X_o$ until the arm of the trailing rolling assembly 140*b* contacts rear stop 218, whereupon further displacement in the opening longitudinal direction is restricted. In this way, rear stop 218 prevents rolling assemblies 140 from rolling off of the guiderail 202 and therefore ensures that a user does not accidentally disengage the door panel 130 from the guiderail assembly 200.

Figure 6A:
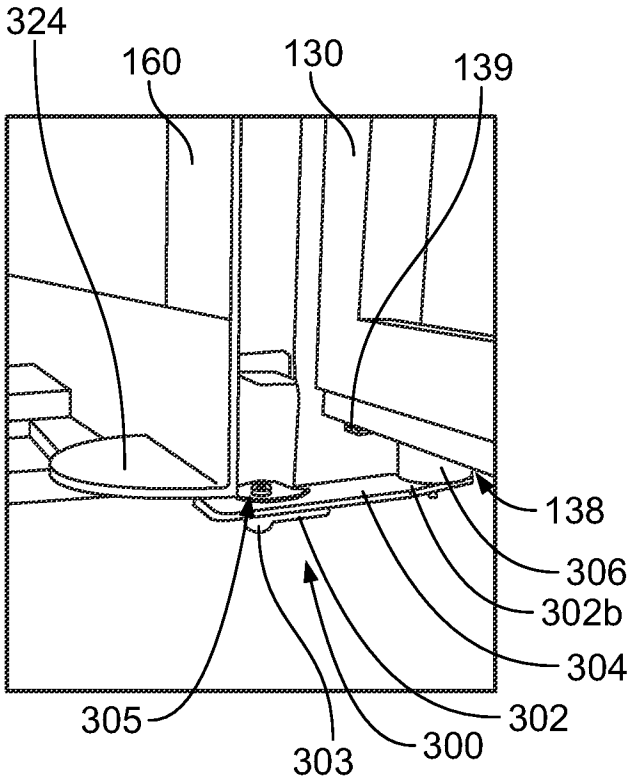
FIGS. 6*a*, 6*b*, and 6*c* are rear perspective detail views of a bottom portion of the sliding door apparatus at positions approaching the transition point, after the transition point, and in the closed position, respectively, according to an embodiment of the invention.
Figure 9A:
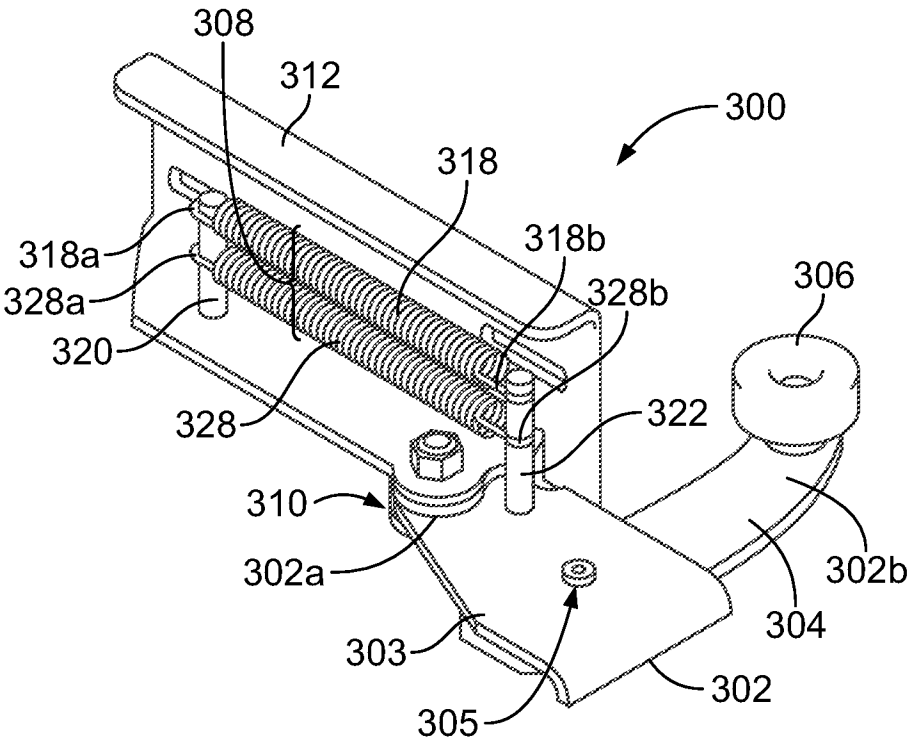
FIGS. 9*a*, 9*b*, 9*c*, and 9*d* are top perspective, top, side and front views, respectively, of a transition support assembly of the sliding door apparatus according to an embodiment of the invention.
Figure 8:
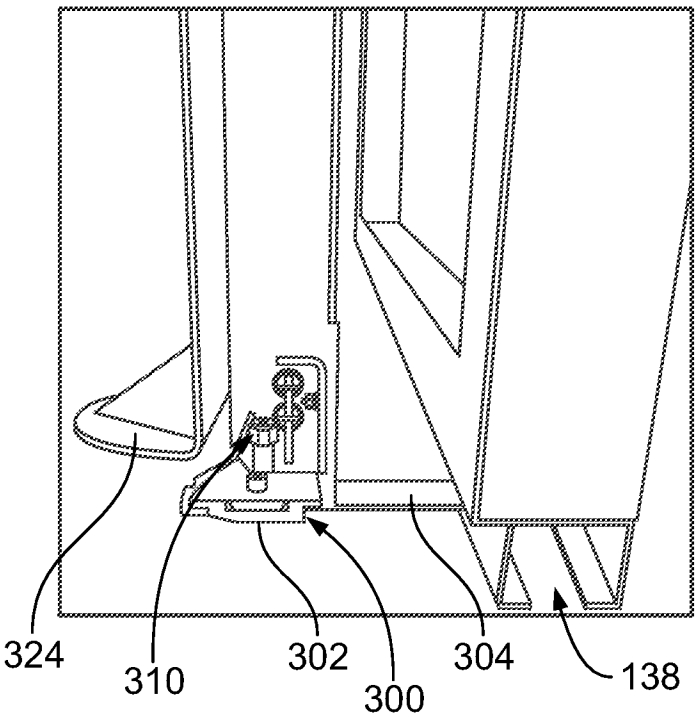
FIG. 8 is a cross sectional detail view of a bottom portion of the sliding door apparatus in the open position, according to an embodiment of the invention.
Figure 9C:
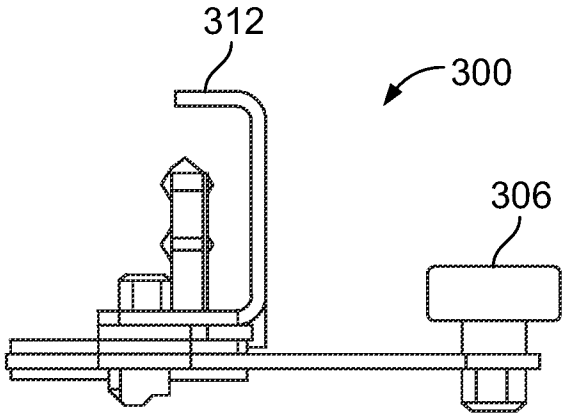
Figure 9D:
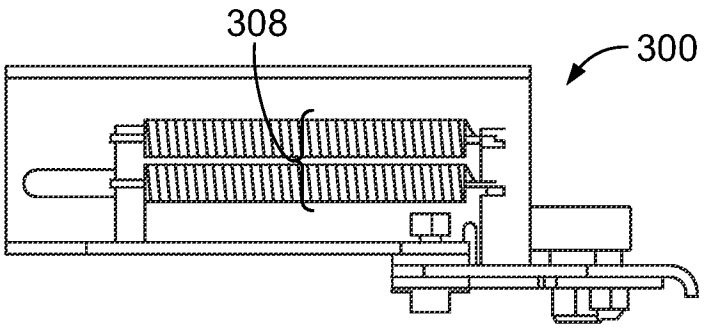
Figure 9B:
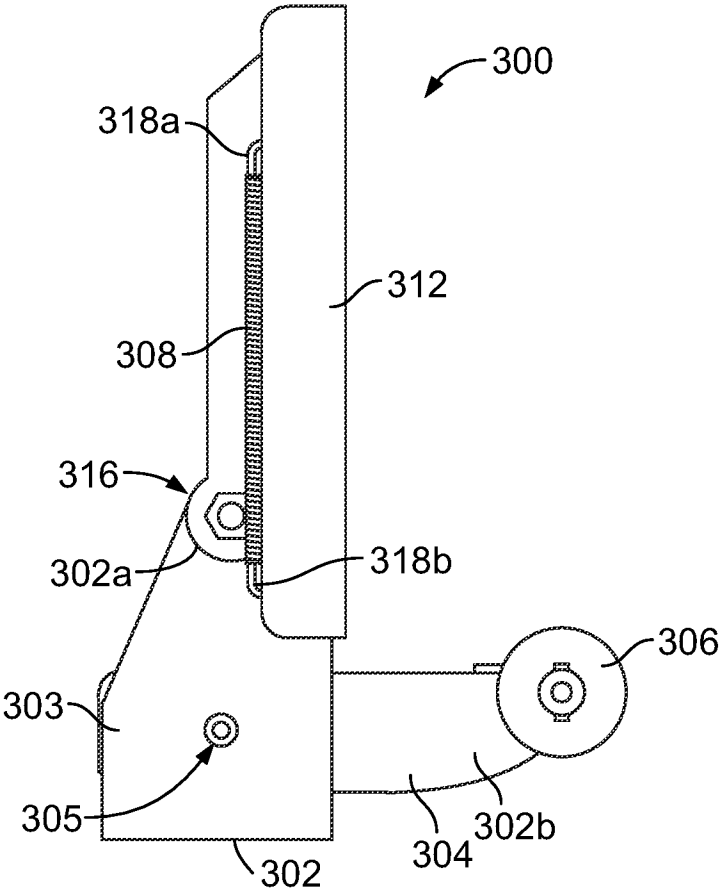
Figure 12:
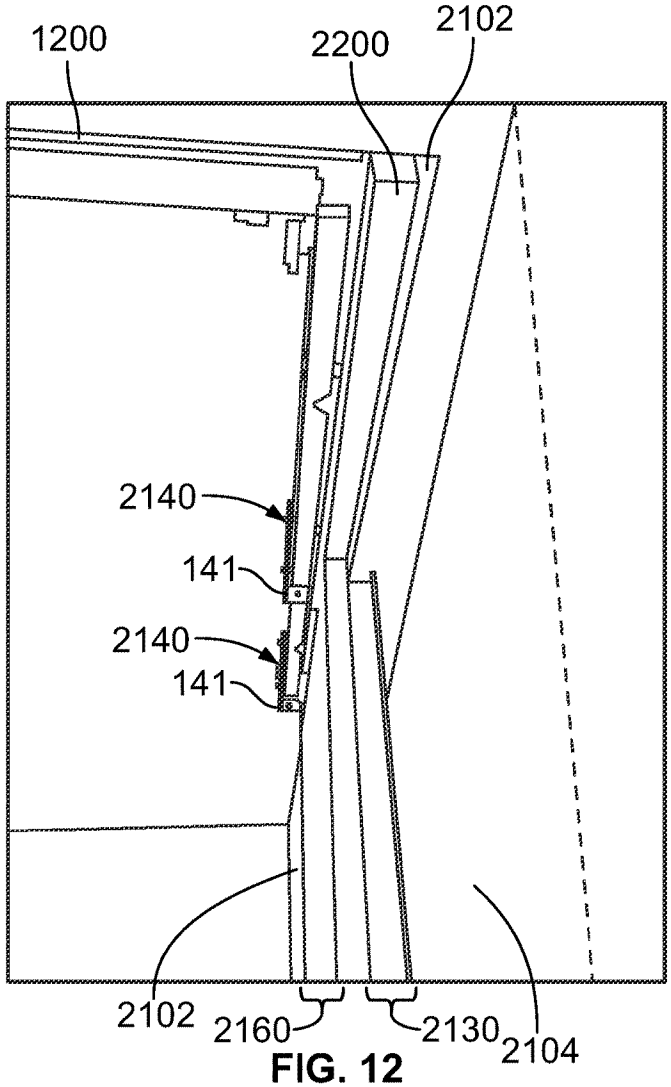
FIG. 12 is a upward perspective view of the upper corner of a dual-sliding door apparatus for a corner installation in an open position according to another embodiment of the invention.

As shown in FIGS. 1*a* and 1*b*, the sliding door system 100 further includes a transition support assembly 300 that increases the stability of the system and also facilitates the transition of the door panel 130 into and out of the closed position. With reference to FIGS. 6*a* through 6*c*, FIGS. 7*a*-7*c*, 8, and FIGS. 9*a*-9*c*, the transition support assembly 300 includes a dual-segmented lever arm 302 having a first segment 303 and a second segment 304 that are attached to one another via a fixed joint 305. As shown in FIG. 9*b*, the first segment 303 and second segment 304 are fixed substantially at a 90 degree angle with respect to one another, such that the first segment 303 is substantially aligned with the longitudinal axis and the second segment 304 is substantially aligned with the transverse axis, as shown in FIG. 9*a*, when in the open position. The lever arm 302 is pivotally attached at a proximal end 302*a* to a fixed panel 160, or to a plate 312 mounted within a bottom frame of the fixed panel 160, as shown in FIG. 6*a*, where the fixed panel has the same general appearance as the door panel 130 but is fixedly attached to the wall 102. Alternatively, the transition support assembly may be attached to the wall 102, or to a plate 312 fixed to the wall, instead of to a fixed panel. In one embodiment, stops within the transition support assembly 300 restrict the rotation of the lever arm 302 substantially to an arc from the closing direction $X_C$ to the inward direction $A_i$. Alternatively, the range of rotation of the lever arm 302 is limited based on interactions of other elements in the system.

A bi-directional spring element 308 biases the lever arm 302 in the opening direction $X_o$ when the door is at the transition point, and biases the lever arm in the outward direction $A_o$ when the door system is in the closed position. The bi-directional spring element 308 has first and second springs (318, 328) that are connected at first ends (318*a*, 328*a*) to the wall 102, or to a plate 312 fixed to the wall, via a post 320. The first and second springs (318, 328) are connected at second ends (318*b*, 328*b*), opposite the first ends, to the lever arm 302 via a post 322 on the second segment 303. Although the spring element 308 is shown as having two springs, one spring may be used; alternatively, more than two springs may be used.

A cover plate 324 (not shown) is attached to the wall 102 in order to protect portions of the spring-assisted transition support assembly from exposure during transition from the transition point into the closed position, and when in the closed position.

Figure 6B:
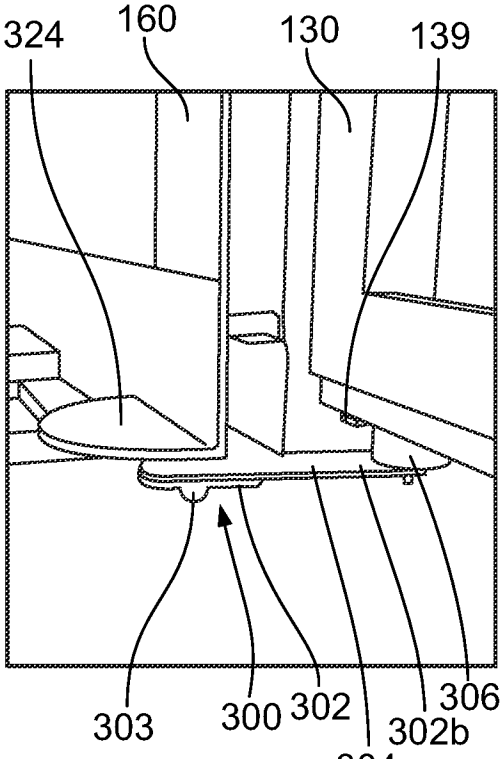
Figure 6C:
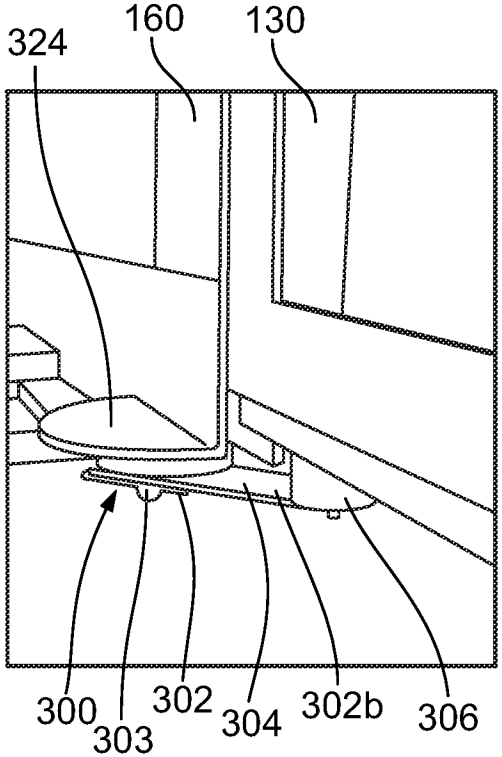
Figure 7C:
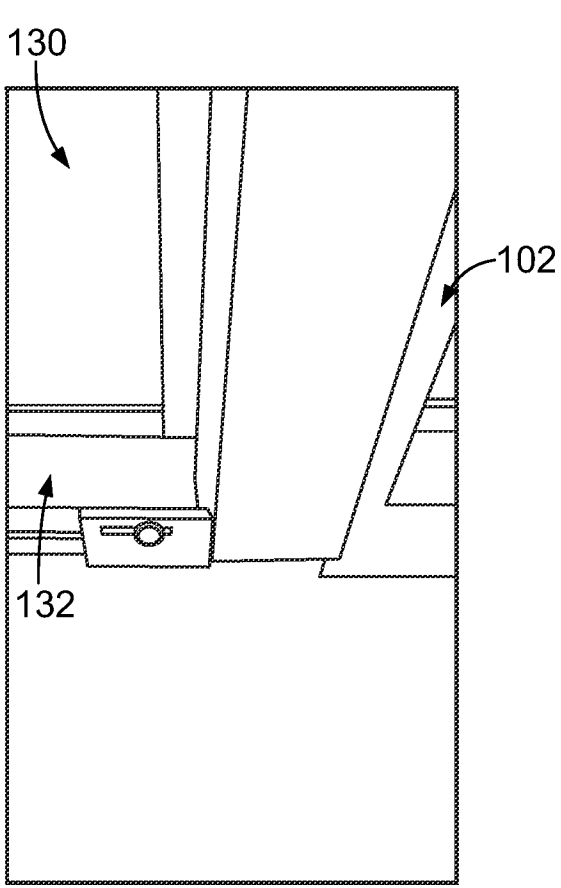
FIGS. 7*a*, 7*b*, and 7*c* are top perspective detail views of a bottom portion of the sliding door apparatus at positions approaching the transition point, after the transition point, and in the closed position, respectively, according to an embodiment of the invention.
Figure 7B:
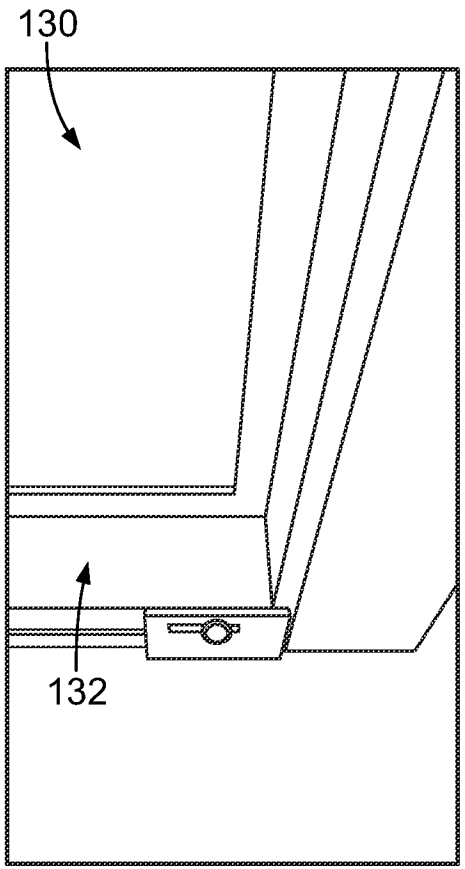
Figure 7A:
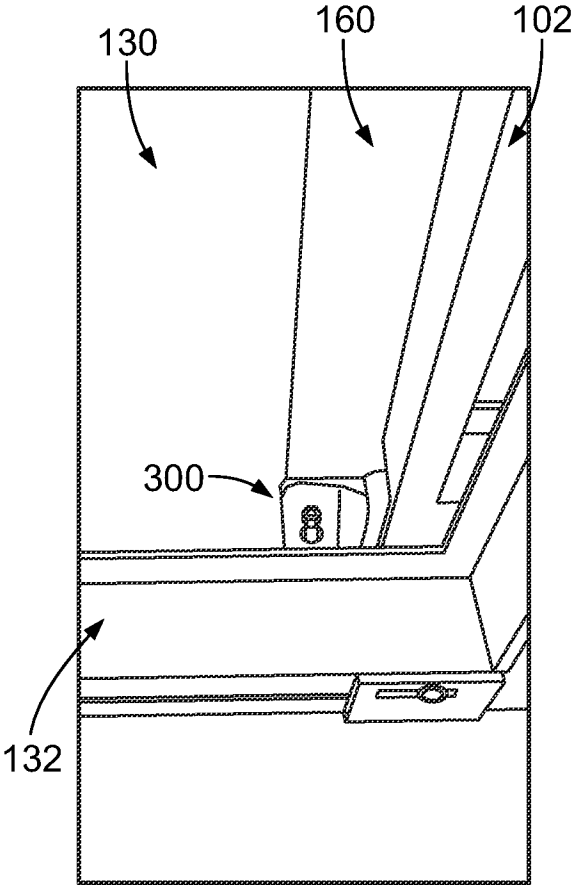

The lever arm 302 has a distal end 302*b* on the second segment 304 that has mounted thereon a cam 306. As shown in the embodiment of FIGS. 6*a* through 6*c* and in FIGS. 9*a*-9*d*, the cam 306 is in the form of a roller having its rotational axis aligned in the vertical direction and adapted to mate with a track 138 on the bottom edge of the door panel 130. In this way, the transition support assembly provides additional stability and support to the door panel by securing and orienting the bottom edge of door panel 130 and preventing the bottom edge from deviations in the transverse axis. A projection 139 is located within the track 138 proximate to the trailing edge 130*b* of the door panel, and at a location such that the it strikes the cam 306 when the door panel 130 reaches the transition point while transitioning from the open position to the closed position. Upon striking the cam 306, projection 139 causes the lever arm 302 in the transition support assembly 300 to pivot from alignment in the inward direction $A_i$ towards alignment in the closing direction $X_c$. As the lever arm pivots, cam 306 exerts a force on the outer edge 138*a* of track 138 to push the door panel 130 in the outward direction $A_o$ and into the closing position.

When the inline sliding door is in the closed position, the transition support assembly 300 assists with transitioning the door out of the closed position and to the transition point. When the door is in the closed position, an external inward force may be applied to the door that is sufficient to overcome the bias of the spring element 308, whereupon the second segment 304 of the lever arm 302 in the transition support assembly 300 begins to pivot from the closing direction $X_c$ towards the inward direction $A_i$. As the lever arm pivots in this manner, cam 306 exerts a force on the inner edge 138*b* of track 138 to push the door panel 130 in the inward direction $A_i$ and out of the closed position. Once the external force has overcome the bias of the spring element 308 towards the inward direction, the force vector of the bi-directional spring element 308 switches and begins to apply a force to second segment of the lever arm causing it to pivot in the direction towards the inward $A_i$ and opening directions $X_o$, thereby assisting in the transition of the door panel 130 out of the closed position and towards the transition point of the system.

In accordance with the above description of the components and assemblies, the overall operation of the inline sliding door system 100 in transition from the fully opened position, through the transition point, and into the closed position is now described. In the fully opened position, the door panel 130 is arranged such that the trailing roller assembly 140*b* is adjacent to rear stop 218 on guiderail 202. In addition, the arms 206 of double-pivot assemblies 204 are aligned in the inward direction such that the guiderail 202 is at its maximum distance inward, and the lever arm 302 of the transition support assembly 300 is aligned in the inward direction. From the opened position, a user imparts a force in the closing direction $X_c$ on the door panel 130, such as through use of the attachment 136. This force causes door panel 130 to slide along the rigid guiderail 202 until the lead rolling assembly 140*a* contacts adjustable stop 216, and the projection 139 in the track 138 of the door panel 130 contacts the cam 306 of the transition support assembly 300, at which point the sliding door system is at the transition point. As the user continues to impart a force on the door panel 130 in the closing direction $X_c$, this force is translated, through the contact of the rolling assembly 140*a* with adjustable stop 216 on the guiderail 202, into a force acting on double-pivot assemblies 204 and causing the arms 206 thereof to pivot at the first hinges 207 toward the closing and outward directions. This force is also translated, through the contact of the projection 139 with cam 306, into a force on the lever arm 302 acting to overcome the bias of bi-directional spring element 308 and causing the distal end of the lever arm 302 to pivot toward the closing and outward directions. Once the bias of the bi-directional spring element 308 toward the opening direction has been overcome, the bi-directional spring element 308 begins to impart a force in the lever arm 302 in the closing direction and inward directions that assists the user in forcing the door into the closing position. The force applied by the bi-directional spring element 308 at this point lessens the amount of external force required by the user to cause the double-pivot assemblies to complete pivoting at the first hinges 207 until the guiderail 202 is brought into contact with the wall mount 208 and the door panel 130 is brought into contact with the stops 116, 118, 120, 122 of opening 104.

In accordance with the above description of the components and assemblies, the transition of the inline sliding door system 100 from the closed position to the fully opened position occurs in the following manner. A user imparts a force in the inward direction $A_i$ on the door panel 130, such as through use of the attachment 136. This force is translated, through the contact of the lead hanging assembly 140*a* with the adjustable stop 216 of guiderail 202, into a force acting on double-pivot assemblies 204 and causing the arms 206 thereof to pivot at the first hinges 207 toward the inward and opening directions. This force is also translated, through the contact of the outer edge 138*a* with the cam 306, into a force on lever arm 302 acting to overcome the bias of bi-directional spring element 308 and causing the distal end of the lever arm to pivot toward the opening and inward directions. Once the bias of the bi-directional spring element 308 toward the closed position has been overcome, the bi-directional spring element 308 begins to impart a force in the lever arm 302 in the inward and opening directions that assists the user in forcing the door towards the transition point. The force then applied by the bi-directional spring element 308 lessens the mount of external force required by the user to cause the double-pivot assembles to complete pivoting at the first hinge 207 until the guiderail is at its maximum inward distance and the door system is at the transition point. After the transition point has been reached, the user imparts a force in the opening direction on the door panel 130, again as through the use of the attachment 136. This force causes door panel 130 to slide along the rigid guiderail 202 until the trailing rolling assembly 140*b* contacts stop 218, at which point the sliding door system is at the fully opened position.

Figure 11B:
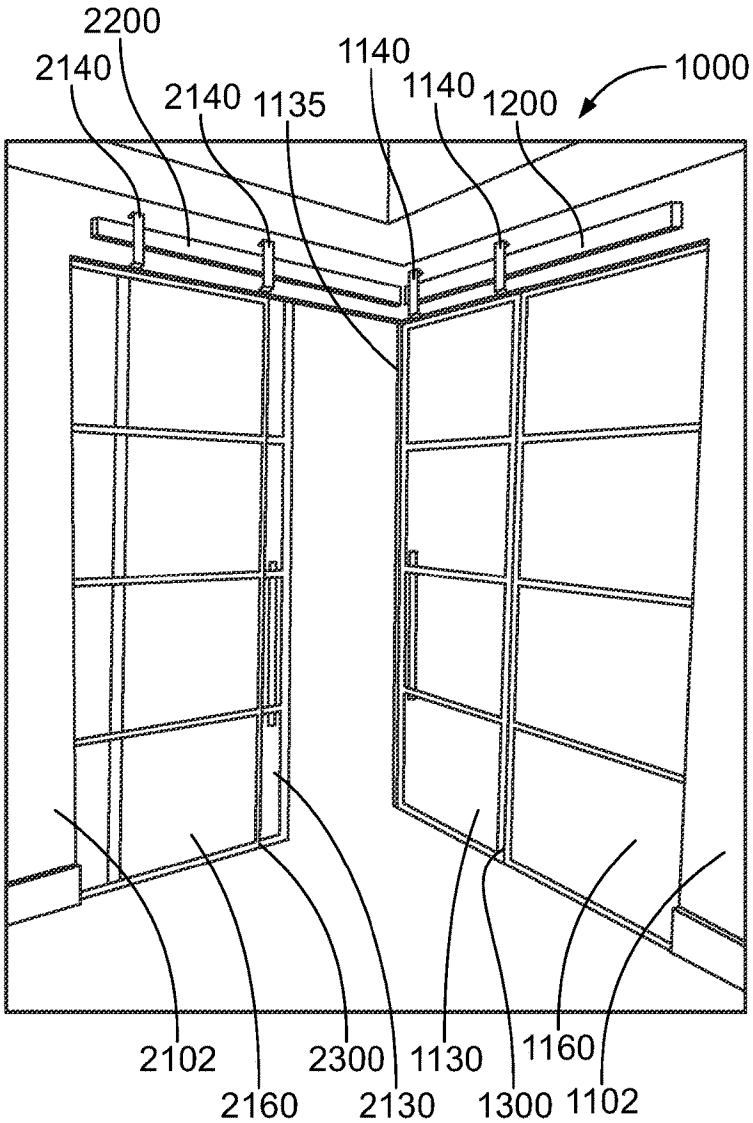
FIGS. 11*a*, 11*b*, and 11*c* are interior perspective views of a dual-sliding door apparatus for a corner installation in an open position, a partially open position, and a closed position, respectively, according to another embodiment of the invention.
Figure 11A:
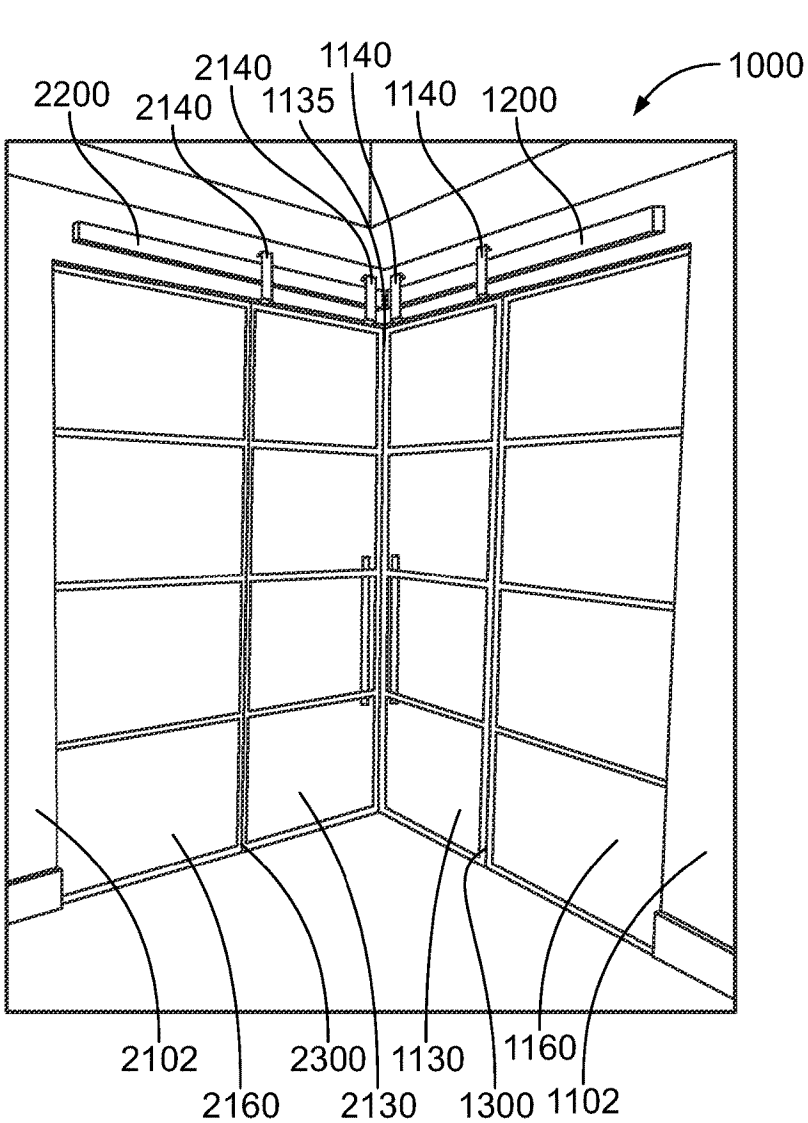
Figure 11C:
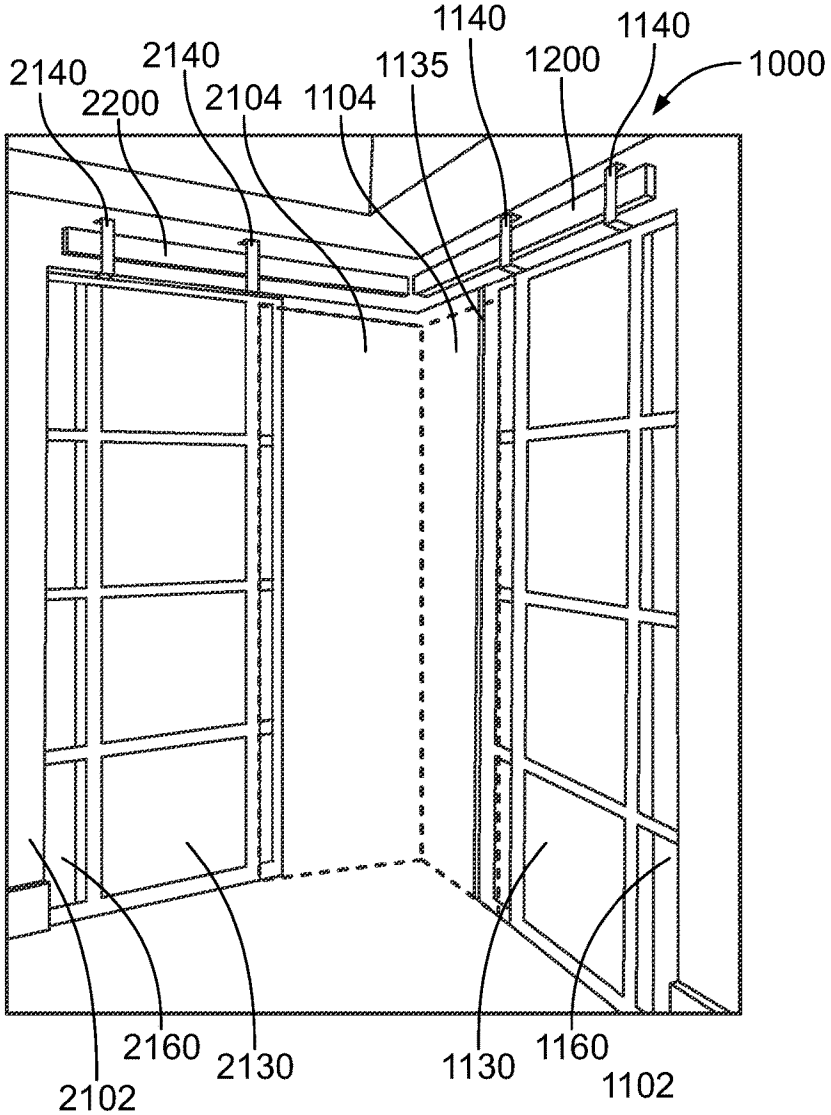
Figure 13B:
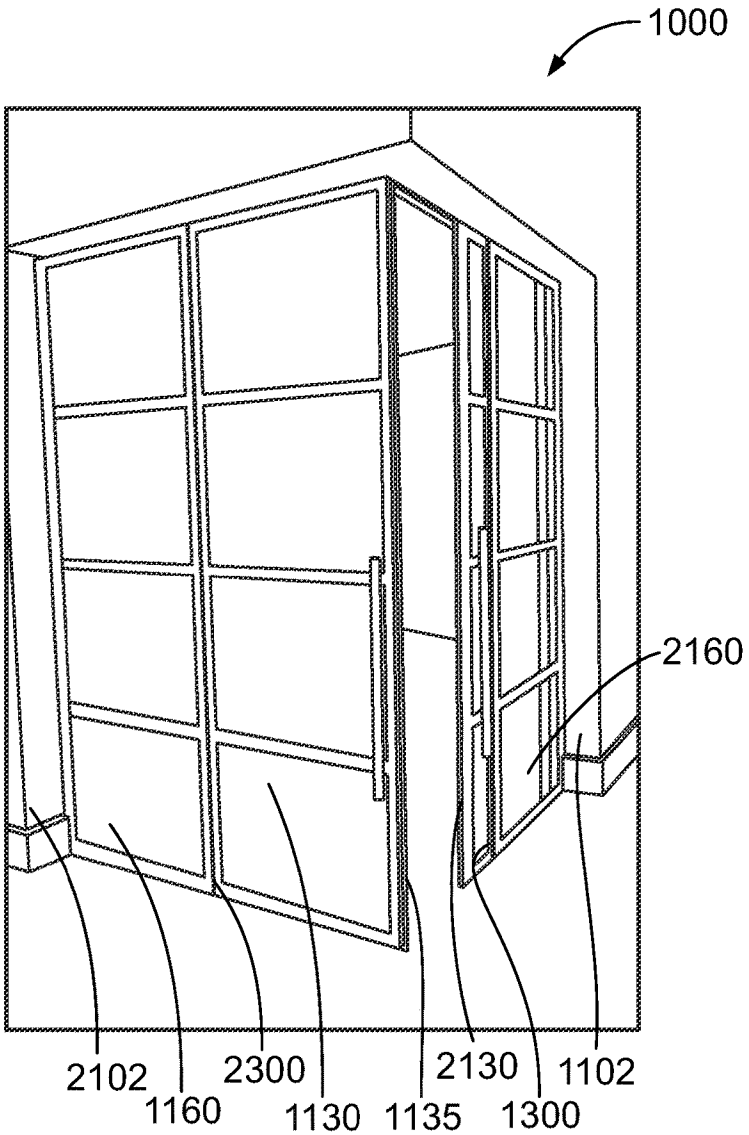
FIGS. 13*a*, 13*b*, and 13*c* are exterior perspective views of a dual-sliding door apparatus for a corner installation in an open position, a partially open position, and a closed position, respectively, according to another embodiment of the invention.
Figure 13A:
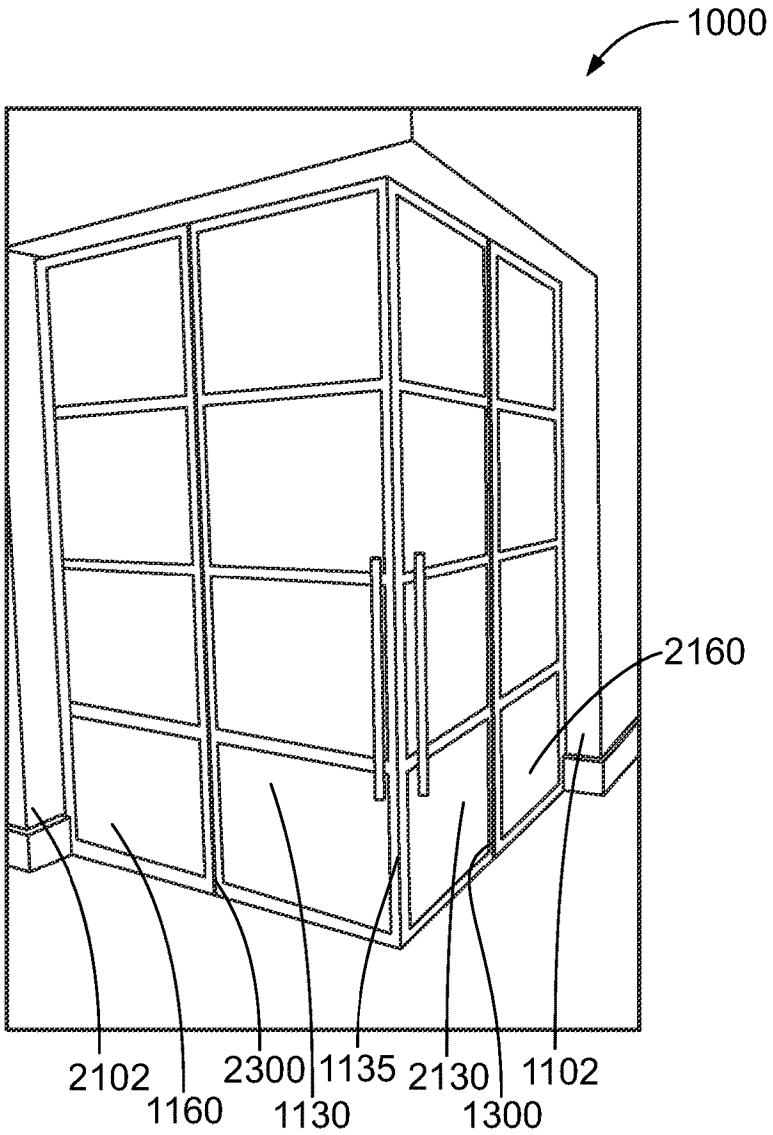
Figure 13C:
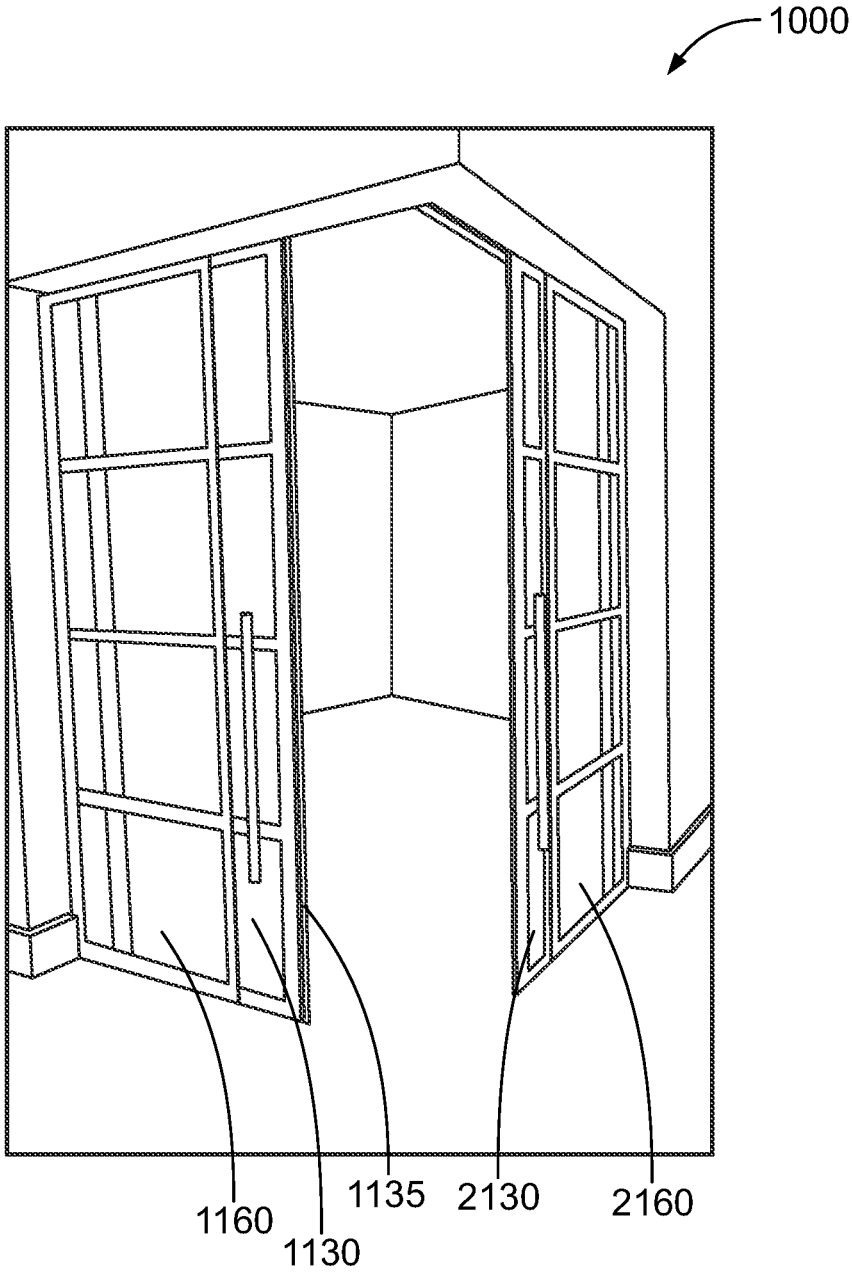

The general components and assemblies described with respect to a single panel embodiment may be adapted for a variety of different wall and opening geometries that include the use of multiple panels. FIGS. 11*a* through 11*c*, 12, and 12*a* through 12*b* illustrate an embodiment of the inline sliding door system 1000 having two door panels 1130 and 2130 that cooperatively service an opening in a corner, without the need for a separate astragal or jamb located at the corner of the wall. As shown in FIG. 11*c*, two walls 1102 and 2102 meet at a corner, and these walls have therein openings 1104 and 2104 that also meet at the corner. Each door panel is connected to a set of roller assemblies 1140, 2140 which are in turn coupled to respective guiderail assemblies 1200, 2200, as each of those assemblies are described above. In addition, each door panel is coupled to a respective transition support assembly 1300, 2300, as that assembly is described above, with each transition support assembly being further coupled to a respective fixed door panels 1160, 2160. One door panel 1130 is the lead panel and is adapted to effectively serve as the astragal for the two door panel system. The lead door panel 1130 has an additional 90 degree astragal plate 1135 that serves as a catch and seal for the secondary door panel 2130 to rest against when in the closed position. This arrangement allows the panels 1130, 2130 to form a sealed and enclosed outside corner, and to do so without a fixed stop or astragal at the corner, either attached the ground or attached to the ceiling or top of the opening, being required.

While the invention has been described in terms of several preferred embodiments, it should be understood that there are many alterations, permutations, and equivalents that fall within the scope of this invention. It should also be noted that there are alternative ways of implementing both the process and apparatus of the present invention. For example, steps do not necessarily need to occur in the orders shown in the accompanying figures, and may be rearranged as appropriate. It is therefore intended that the appended claim includes all such alterations, permutations, and equivalents as fall within the true spirit and scope of the present invention.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar references in the context of this disclosure (especially in the context of the following claims) are to be construed to cover both the singular and the plural, unless otherwise indicated herein or clearly contradicted by context. All methods described herein can be performed in any suitable order unless otherwise indicated herein or otherwise clearly contradicted by context. The use of any and all examples, or exemplary language (e.g., such as, preferred, preferably) provided herein, is intended merely to further illustrate the content of the disclosure and does not pose a limitation on the scope of the claims. No language in the specification should be construed as indicating any non-claimed element as essential to the practice of the present disclosure.

Multiple embodiments are described herein, including the best mode known to the inventors for practicing the claimed invention. Of these, variations of the disclosed embodiments will become apparent to those of ordinary skill in the art upon reading the foregoing disclosure. The inventors expect skilled artisans to employ such variations as appropriate (e.g., altering or combining features or embodiments), and the inventors intend for the invention to be practiced otherwise than as specifically described herein. Accordingly, this invention includes all modifications and equivalents of the subject matter recited in the claims appended hereto as permitted by applicable law. Moreover, any combination of the above described elements in all possible variations thereof is encompassed by the invention unless otherwise indicated herein or otherwise clearly contradicted by context.

The use of individual numerical values are stated as approximations as though the values were preceded by the word "about" or "approximately." Similarly, the numerical values in the various ranges specified in this application, unless expressly indicated otherwise, are stated as approximations as though the minimum and maximum values within the stated ranges were both preceded by the word "about" or "approximately." In this manner, variations above and below the stated ranges can be used to achieve substantially the same results as values within the ranges. As used herein, the terms "about" and "approximately" when referring to a numerical value shall have their plain and ordinary meanings to a person of ordinary skill in the art to which the disclosed subject matter is most closely related or the art relevant to the range or element at issue. The amount of broadening from the strict numerical boundary depends upon many factors. For example, some of the factors which may be considered include the criticality of the element and/or the effect a given amount of variation will have on the performance of the claimed subject matter, as well as other considerations known to those of skill in the art. As used herein, the use of differing amounts of significant digits for different numerical values is not meant to limit how the use of the words "about" or "approximately" will serve to broaden a particular numerical value or range. Thus, as a general matter, "about" or "approximately" broaden the numerical value. Also, the disclosure of ranges is intended as a continuous range including every value between the minimum and maximum values plus the broadening of the range afforded by the use of the term "about" or "approximately." Thus, recitation of ranges of values herein are merely intended to serve as a shorthand method of referring individually to each separate value falling within the range, unless otherwise indicated herein, and each separate value is incorporated into the specification as if it were individually recited herein.

I claim:

1. A sliding door system capable of an inline closure for a first opening in a rigid structure and having an associated open position and a closed position, the system comprising:

a first door panel having a top portion and a bottom portion;

a first guiderail assembly comprising a guiderail and a plurality of hinge assemblies, each hinge assembly having a first hinge coupled to the guiderail and a second hinge coupled to the structure;

one or more first roller assemblies having an upper portion slidably coupled to the first guiderail and a lower portion coupled to the top portion of the first door panel, thereby permitting the first door panel to slide along the first guiderail in a first direction associated with opening of the first door panel, and in a second direction associated with closing of the first door panel; and a first front stop directly coupled to the first guiderail that engages with at least one of the roller assemblies in order to limit the extent to which the first door panel can slide along the first guiderail in the second direction, and to operate as a catch that causes the hinge assemblies to pull the first guiderail towards the structure, thereby pulling the first door panel into a plane of the first opening, wherein the first opening is adjacent to a second opening such that the first opening and the second opening meet at a corner of the structure, and wherein the system further comprises:

a second door panel having a top portion and a bottom portion;

a second guiderail assembly comprising a second guiderail and a plurality of hinge assemblies, each hinge assembly of the second guardrail assembly having a first hinge coupled to the second guiderail and a second hinge coupled to the structure;

one or more second roller assemblies having an upper portion slidably coupled to the second guiderail and a lower portion coupled to the top portion of the second door panel, thereby permitting the second door panel to slide along the second guiderail in a third direction associated with opening of the second door panel, and in a fourth direction associated with closing of the second door panel; and a second front stop directly coupled to the second guiderail that engages with at least one of the second roller assemblies in order to limit the extent to which the second door panel can slide along the second guiderail in the fourth direction, and to operate as a catch that causes the hinge assemblies of the second guiderail assembly to pull the second guiderail towards the structure, thereby pulling the second door panel into a plane of the second opening.

2. The sliding door system of claim 1 wherein the first door panel has an astragal plate that serves as a catch for the second door panel when the first door panel and the second door panel are in their respective closed positions.

3. A sliding door system capable of inline closure for a corner opening in a rigid structure, the corner opening having a first portion in a first wall corresponding to a first side of the corner opening, and a second portion in a second wall corresponding to a second side of the corner opening, the system having an associated open position and a closed position, the system comprising:

a first inline sliding door assembly comprising a first door panel;

a first guiderail assembly comprising a first guiderail and a plurality of first hinge assemblies, each first hinge assembly having a first hinge coupled to the first guiderail and a second hinge coupled to the first wall;

one or more first roller assemblies having an upper portion slidably coupled to the first guiderail and a lower portion coupled to the top portion of the first door panel, thereby permitting the first door panel to slide along the first guiderail in a first direction associated with opening of the first door panel, and in a second direction associated with closing of the first door panel; and a first front stop directly coupled to the first guiderail that engages with at least one of the first roller assemblies in order to limit the extent to which the first door panel can slide along the first guiderail in the second direction, and to operate as a catch that causes the first hinge assemblies to pull the first guiderail towards the second wall, thereby pulling the first door panel into a plane of the first portion of the corner opening; and a second inline sliding door assembly comprising a second door panel;

a second guiderail assembly comprising a second guiderail and a plurality of second hinge assemblies, each second hinge assembly having a third hinge coupled to the second guiderail and a fourth hinge coupled to the second wall;

one or more second roller assemblies having an upper portion slidably coupled to the second guiderail and a lower portion coupled to the top portion of the second door panel, thereby permitting the second door panel to slide along the second guiderail in a third direction associated with opening of the second door panel, and in a fourth direction associated with closing of the second door panel; and a second front stop directly coupled to the second guiderail that engages with at least one of the second roller assemblies in order to limit the extent to which the second door panel can slide along the second guiderail in the fourth direction, and to operate as a catch that causes the second hinge assemblies to pull the second guiderail towards the second wall, thereby pulling the second door panel into a plane of the second portion of the corner opening.

4. The sliding door system of claim 3 wherein the first door panel has an astragal plate that serves as a catch for the second door panel when the first door panel and the second door panel are in their respective closed positions.

5. The sliding door system of claim 3, wherein the second hinge of each hinge assembly is indirectly coupled to a structure via a wall mount, wherein the wall mount is fixedly attached to the structure.

6. The sliding door system of claim 3 further comprising first and second transition support assemblies to increase system stability and facilitate transition into and out of a closed position, each transition support assembly comprising a lever arm having a proximal end pivotally attached to a structure, and a distal end, wherein the distal end of the lever arm of the first transition support assembly is slidably coupled to the bottom portion of the first door panel, and the distal end of the lever arm of the second transition support assembly is slidably coupled to the bottom portion of the second door panel.

7. The sliding door system of claim 6 wherein the first and second transition support assemblies each further comprises one or more spring elements coupled between the lever arm and the wall of the structure.

* * * * *